US005362413A

United States Patent [19]

Kaufmann et al.

[11] Patent Number: 5,362,413

[45] Date of Patent: Nov. 8, 1994

[54] LOW-TEMPERATURE-EFFECTIVE DETERGENT COMPOSITIONS AND DELIVERY SYSTEMS THEREFOR

[75] Inventors: Edward J. Kaufmann, San Ramon; James R. Wiersig, Los Altos; James F. Wilts, Richmond, all of Calif.

[73] Assignee: The Clorox Company, Oakland, Calif.

[21] Appl. No.: 640,741

[22] Filed: Jan. 14, 1991

Related U.S. Application Data

[63] Continuation of Ser. No. 475,668, Feb. 6, 1990, abandoned, which is a continuation-in-part of Ser. No. 867,639, May 23, 1986, abandoned, which is a continuation of Ser. No. 592,660, Mar. 23, 1984, abandoned.

[51] Int. Cl.[5] ..... C11D 17/08; C11D 10/02; C11D 1/66; C11D 3/04

[52] U.S. Cl. ..... 252/174; 252/90; 252/92; 252/135; 252/174.21; 252/DIG. 1; 252/DIG. 14

[58] Field of Search ..... 252/90, 92, 135, 174, 252/174.21, 174.22, DIG. 1, DIG. 14

[56] References Cited

U.S. PATENT DOCUMENTS

| | | | |
|---|---|---|---|
| 2,746,932 | 5/1956 | Vitale | 252/138 |
| 2,804,395 | 8/1957 | Boyajian | 117/44 |
| 2,956,025 | 10/1960 | Lew | 252/161 |
| 3,113,674 | 12/1963 | Kiefer et al. | 206/84 |
| 3,148,166 | 9/1964 | Suzumura | 260/31.2 |
| 3,169,930 | 2/1965 | Gedge | 252/135 |
| 3,186,869 | 6/1965 | Friedman | 117/138.8 |
| 3,198,740 | 8/1965 | Dunlop, Jr. et al. | 252/90 |
| 3,240,712 | 3/1966 | Schulerud | 252/138 |
| 3,277,009 | 10/1966 | Freifeld et al. | |
| 3,300,546 | 1/1967 | Beachtold | 260/876 |
| 3,316,190 | 4/1967 | Suzumura | 260/17.4 |
| 3,322,674 | 5/1967 | Friedman | 252/90 |
| 3,366,592 | 1/1968 | Beeman | 260/33.4 |
| 3,374,195 | 3/1968 | Bianco et al. | 260/29.6 |
| 3,380,925 | 4/1968 | Blaser et al. | 252/161 |
| 3,409,598 | 1/1968 | Takigawa et al. | 260/78.5 |
| 3,413,229 | 11/1968 | Bianco et al. | 252/90 |
| 3,445,426 | 5/1969 | Lee | 260/46.5 |
| 3,472,783 | 10/1969 | Smillie | 252/89 |
| 3,505,303 | 4/1970 | Lindemann | 260/91.3 |
| 3,507,798 | 4/1970 | Egan et al. | 252/135 |
| 3,528,921 | 9/1970 | Gray | 252/99 |
| 3,528,924 | 9/1970 | Chapuis | 252/161 |
| 3,549,544 | 12/1970 | Johnson | 252/152 |
| 3,594,234 | 7/1971 | Sayers et al. | 252/137 |
| 3,619,119 | 11/1971 | Felletschin | 8/137 |
| 3,625,909 | 12/1971 | Berg et al. | 252/153 |
| 3,626,559 | 12/1971 | Rossmann et al. | 29/1 |
| 3,630,929 | 12/1971 | van Dijk | 252/136 |
| 3,632,786 | 1/1972 | Nickerson | 260/29.6 |
| 3,634,260 | 1/1972 | Pickin | 252/95 |

(List continued on next page.)

FOREIGN PATENT DOCUMENTS

| | | | |
|---|---|---|---|
| 714111 | 7/1965 | Canada | 400/25 |

(List continued on next page.)

OTHER PUBLICATIONS

Schick, *Nonionic Surfactants*, vol. 2, 1967, pp. 604–608 Chapter 18, "Emulsification".

(List continued on next page.)

*Primary Examiner*—Paul Lieberman
*Assistant Examiner*—Erin M. Higgins

[57] ABSTRACT

The invention provides novel low temperature detergent mull compositions comprising:

A detergent composition which comprises (a) solid builder, (b) liquid surfactant and, optionally, (c) one or more adjuncts, in the form of a low-temperature wash water dispersible, phase stable mull whose solid phase consists essentially of particulate solid builder having an average particle size greater than 10 microns and whose liquid phase consists essentially of at least one non-ionic surfactant, wherein said liquid phase has a pour point of less than 75° F., thereby rendering said mull readily dispersible in cold wash water, and wherein said mull is rendered phase stable by the presence thereby of (i) a weight percent amount of said particulate builder which exceeds the weight percent of said liquid nonionic surfactant, or (ii) 0.1% to 5% by weight of the mull of added water, or (iii) both.

18 Claims, No Drawings

U.S. PATENT DOCUMENTS

| | | | |
|---|---|---|---|
| 3,649,569 | 3/1972 | McCarthy | 252/543 |
| 3,679,608 | 7/1972 | Aubert et al. | 252/526 |
| 3,697,451 | 10/1972 | Mausner et al. | 252/545 |
| 3,705,102 | 12/1972 | Mast | 252/89 |
| 3,717,616 | 2/1973 | Chakrabarti | 260/78.5 |
| 3,720,621 | 3/1973 | Smeets | 252/135 |
| 3,741,902 | 6/1973 | Barrett | 252/90 |
| 3,741,911 | 6/1973 | Shane | 252/527 |
| 3,769,222 | 10/1973 | Yurko et al. | 252/89 |
| 3,775,334 | 11/1973 | Christie | 252/171 |
| 3,850,831 | 11/1974 | Hellsten et al. | 252/99 |
| 3,868,336 | 2/1975 | Mazzola et al. | 252/527 |
| 3,892,905 | 7/1975 | Albert | 428/220 |
| 3,925,224 | 12/1975 | Winston | 252/89 |
| 3,931,033 | 1/1976 | Lohr et al. | 252/122 |
| 3,953,382 | 4/1976 | Nelson et al. | 252/548 |
| 3,969,282 | 7/1976 | Kappler et al. | 252/559 |
| 3,981,826 | 9/1976 | Munro | 252/526 |
| 3,983,078 | 9/1976 | Collins | 252/540 |
| 3,993,103 | 11/1976 | Schmidgall | 206/229 |
| 3,994,818 | 11/1976 | Van der Loo et al. | 252/171 |
| 4,049,558 | 9/1977 | Rasmussen | 252/8.9 |
| 4,058,473 | 11/1977 | Cantor | 252/121 |
| 4,082,678 | 4/1978 | Prachet et al. | 252/8.6 |
| 4,088,598 | 5/1978 | Williams | 252/135 |
| 4,089,795 | 5/1978 | Bailey et al. | 252/135 |
| 4,101,457 | 7/1978 | Place et al. | 252/559 |
| 4,107,067 | 8/1978 | Murphy et al. | 252/135 |
| 4,107,360 | 8/1978 | Schmidgall | 427/389 |
| 4,108,600 | 8/1978 | Wong | 8/137 |
| 4,115,292 | 9/1978 | Richardson et al. | 252/90 |
| 4,115,308 | 9/1978 | Guerry | 252/135 |
| 4,155,971 | 5/1979 | Wysong . | |
| 4,162,987 | 7/1979 | Maguire, Jr. et al. | 252/135 |
| 4,176,079 | 11/1979 | Guerry et al. | 252/90 |
| 4,188,304 | 2/1980 | Clarke et al. | 252/93 |
| 4,201,686 | 5/1980 | Augustijn | 252/174.22 |
| 4,233,171 | 11/1980 | McLaughlin et al. | 252/99 |
| 4,257,908 | 3/1981 | Wixon | 252/135 |
| 4,264,466 | 4/1981 | Carleton et al. | 252/99 |
| 4,289,815 | 9/1981 | Lee | 428/35 |
| 4,311,608 | 1/1982 | Maurice | 252/143 |
| 4,316,812 | 2/1982 | Hancock et al. | 252/99 |
| 4,326,904 | 4/1982 | Eckert et al. | 156/85 |
| 4,348,293 | 9/1982 | Clarke et al. | 252/90 |
| 4,356,099 | 10/1983 | Davies et al. | 252/90 |
| 4,409,136 | 10/1983 | Cheng | 252/540 |
| 4,410,441 | 10/1983 | Davies et al. | 206/0.5 |
| 4,416,791 | 11/1983 | Haq | 252/90 |
| 4,436,653 | 3/1984 | Jacobsen et al. | 252/547 |
| 4,438,024 | 3/1984 | Del Greco et al. | 252/545 |
| 4,626,372 | 12/1986 | Kaufmann et al. | 252/90 |
| 4,743,394 | 5/1988 | Kaufmann et al. | 252/90 |
| 4,753,750 | 6/1988 | Ouhadi et al. | 252/139 |

FOREIGN PATENT DOCUMENTS

| | | | |
|---|---|---|---|
| 1100260 | 5/1981 | Canada | D06O 19/00 |
| 11502 | 5/1980 | European Pat. Off. | C11D 17/04 |
| 79712 | 5/1983 | European Pat. Off. | C11D 17/04 |
| 1551810 | 9/1970 | France | C11D 3/00 |
| 2919886 | 11/1979 | Germany | C11D 3/22 |
| 87542 | 7/1976 | Japan | C09J 3/14 |
| 785655 | 10/1957 | United Kingdom . | |
| 1118297 | 6/1968 | United Kingdom | C11D 1/72 |
| 1205711 | 9/1970 | United Kingdom | C11D 1/863 |
| 1399966 | 7/1975 | United Kingdom | C11D 101/02 |
| 2090603 | 7/1982 | United Kingdom | C08L 29/04 |
| 2109706 | 6/1983 | United Kingdom | B32B 5/28 |

OTHER PUBLICATIONS

Schwartz et al, *Surface Active Agents and Detergents*, vol. II, 1977 pp. 479–480.

Shell Neodol Advertisement in *Chemical and Engineering New*, Jan. 24, 1983.

Odian, *Principles of Polymerization*, pp. 28–33 (1970).

Seymour, *Introduction to Polymer Chemistry*, pp. 14–23 (1971).

Chem. Abs. 80: 96810q, 1974.

LOW-TEMPERATURE-EFFECTIVE DETERGENT COMPOSITIONS AND DELIVERY SYSTEMS THEREFOR

This is a continuation of Ser. No. 475,668, filed Feb. 6, 1990, now abandoned, itself a continuation-in part application of Ser. No. 867,639, filed May 23, 1986, now abandoned, which is a continuation of Ser. No. 592,660, filed Mar. 23, 1984, now abandoned, whose disclosures are incorporated herein by reference.

TECHNICAL FIELD

The within disclosed invention relates to detergent mull compositions and delivery means therefor.

BACKGROUND OF THE INVENTION

It is well known to those skilled in the art that nonionic surfactants are useful in formulating laundry detergents for use in low water temperature washes. It is further known that nonionic surfactants are particularly efficient at removing oily soils from synthetic fabrics but that they are not as efficient at removing particulate soils as anionic surfactants. As a result it is desirable to include detergent builders in detergent formulations containing nonionic surfactants to improve performance on particulate soils and provide good overall cleaning performance. However, the amount of nonionic surfactant that can be included in powder detergents is limited by the amount that can be absorbed into or adsorbed onto the solid components. Agglomeration techniques usually produce dense particles that have little capacity for absorbing nonionic surfactants and the final compositions usually have poor solubility rates and flowability. Spray-drying techniques produce more porous particles that can sorb more nonionic surfactant. However, the temperatures involved in spray-drying can cause oxidation of the nonionic surfactant and it is desirable to add the nonionic surfactant in a second step if a high concentration is desired. Since the spray-drying process is energy and capital intensive, this approach results in high manufacturing costs. In addition, if certain builders are present, the spray-drying process itself can lead to the formation of insoluble particles that deposit on clothes during the washing process.

High levels of nonionic surfactants can be readily incorporated into liquid laundry detergents. However, these formulations are normally severely limited in the type and amount of builder that can be incorporated therein since the builder must be soluble or dispersible in the formulation to prevent phase separation. As a result, the overall particulate soil removal performance of liquid laundry detergents is generally poorer than that of powder detergents.

U.S. Pat. No. 4,316,812, issued to Hancock et al, appears to disclose liquid detergent compositions containing builders, a bleach, and a nonionic surfactant system, in which the solids have an average particle diameter of less than 10 microns and the nonionic surfactant system has a pour point of less than 10° C. However, it is expensive and inconvenient to use most conventional builders and most other solids at such a small particle size and a potential for the development of health and safety problems related to dusting with these builders and solids exists. Post milling the composition to reduce the particle size of the solids may eliminate the health and safety problems, but it requires an extra processing step that is energy intensive, and it generates significant heat which may affect temperature-sensitive compounds of the composition. Furthermore it may have a deleterious effect on encapsulated materials within the composition. Furthermore, no mention is made of the solubility characteristics of these formulations in cold water.

There have been attempts to combine high levels of nonionic surfactants and builders in laundry detergent formulations which have the physical form of mulls or pastes. U.S. Pat. No. 4,264,466, issued to Carleton et al, describes detergent mulls which contain chain structure clays to prevent phase separation of the liquid and solid components. U.S. Pat. No. 4,409,136, issued to Cheng, discloses a paste detergent composition containing a specific nonionic surfactant along with a relatively high amount of water.

Because of the viscous nature of these paste formulations, it is difficult to deliver them into the washing machine from a conventional, liquid laundry detergent bottle, even one equipped with a pump dispenser. The use of a squeezable tube, similar to those used to dispense toothpaste, to dispense a liquid detergent in the form of a paste may be feasible from a technical consideration, but the size of the tube required to contain a reasonable amount of detergent for multiple wash loads would make it difficult for the consumer to use conveniently.

The use of pouches constructed of water soluble films to deliver unit dosages of laundry additives is well documented. However, there has been no demonstration in the prior art of the use of such pouches to contain and deliver a composition containing a high level of nonionic surfactant. For example, U.S. Pat. No. 4,115,292, issued to Richardson et al, shows compositions with low amounts of very high pour point nonionic surfactants and relatively high amounts of water in water-soluble polyvinyl alcohol pouches.

SUMMARY OF THE INVENTION

Because the steady rise in energy costs has made energy intensive manufacturing processes much less attractive, it is an object of this invention to provide detergent mull compositions containing high amounts of nonionic surfactants which do not require high energy consumptive processes for their production.

Because there has been a trend in domestic laundry towards lowered wash temperatures, it is a further object of this invention to provide detergent compositions in the form of mulls which have excellent solubility or dispersibility in cool and cold water and which efficiently remove both particulate and oily soils.

It is a still further object of this invention to provide detergent compositions in the form of mulls which have excellent rates of dispersion/dissolution in cool and cold water and which have good phase stability without the addition of clays or other costly phase-stabilizing ingredients and without the requirement of an extremely small average particle size for the solid components of the mulls.

It is another object of this invention to provide a method for conveniently packing, storing and delivering these detergent compositions to washing machines.

The detergent compositions of this invention comprise:

A detergent composition comprising (a) solid builder, (b) liquid surfactant and, optionally, (c) one or more adjuncts, in the form of a low-temperature wash water dispersible, phase stable mull whose solid phase consists essentially of particulate solid builder having an average particle size greater than about 10 microns and whose liquid phase consists essentially of at least one non-ionic surfactant, wherein said liquid phase has a pour point preferably of less than 75° F., thereby rendering said mull readily dispersible in cold wash water, and wherein said mull is rendered phase stable by the presence thereby of (i) a weight percent amount of said particulate builder which exceeds the weight percent of said liquid nonionic surfactant, or (ii) an amount from 0.1% to 5% by weight of the mull of added water effective to impart a viscosity to the mull of about 10,000 to 100,000 centipoise, or (iii) both.

In the invention the term "added water" means water introduced in liquid form either as liquid water itself or as an additive to the surfactant.

As will be more specifically discussed herein, the novel detergent mull compositions are rapidly soluble/-dispersible in cold water and yet surprisingly provide good removal of oily and particulate soils from both natural and synthetic fibers, even though the HLB values of the surfactant systems of these compositions may be lower than is considered optimum for good detergency.

In a further embodiment, the invention provides novel low-temperature-effective detergent mull compositions comprising:

(a) a builder; and (b) a mixture of nonionic surfactants having a combined pour point less than 75° F., preferably less than 65° F., and most preferably less than 40° F.;

wherein the compositions have an average viscosity of about 10,000–100,000 centipoise (cps) at 25° C. and at 6.25 revolutions per minute as measured on a Haake Rotoviscometer with an MVII sensor.

More preferably, the compositions of this embodiment have an average viscosity of about 20,000–60,000 cps and most preferably 30,000–50,000 cps under the same rheological test conditions.

In a still further embodiment, the invention provides a means for eliminating phase separation in these detergent mull compositions by adding about 0.1 to 5.0% by weight of the composition (unless otherwise specified, all further measures herein are by percent by weight of the composition) water to the detergent mull compositions of the prior embodiments. This eliminates the need for the addition of more expensive materials, such as clays, and reduces the phase separation without significantly reducing the cold water solubility of the composition.

In yet another embodiment, the invention provides a premeasured, low temperature effective delivery system comprising:

a water soluble delivery pouch which contains a low-temperature-effective detergent mull which comprises:

(a) a builder; and (b) a nonionic surfactant system, wherein the pour point of the system is preferably less than 75° F., wherein the average particle size of the solid components of the mull is at least and preferably greater than 10 microns.

Furthermore, in any of the inventive detergent mull compositions or in the low temperature effective detergent delivery system described above, can be added further surfactants which do not render detergent solubility/dispersibility unacceptable, fluorescent whitening agents, bleaches, corrosion inhibiting agents, anti-redeposition agents, enzymes, dyes, pigments, fabric softeners, fragrances and other adjuncts.

The invention further provides a method of laundering fabrics by contacting the fabrics with the foregoing detergent mull compositions or with water into which the composition has been dissolved or dispersed, or by contacting the fabric with water to which the low temperature delivery system has been added.

DETAILED DESCRIPTION OF THE INVENTION

In the invention, the following terms, all of which find original support in the parent application Ser. No. 867,639, filed May 23, 1986, which itself is a continuation of the grandparent application, filed Mar. 23, 1984, are used:

The physical form of the detergent compositions of this invention is a mull which is a viscous suspension of a solid phase in a liquid phase. The mulls of this invention comprise a concentrate of solid particles which are suspended in a liquid phase. Because of the unique formulations used in this invention, phase instability, which is the tendency for the liquid and solid phases to separate, is avoided.

The solid phase of said mull consists essentially of a particulate solid builder having an average particle size of greater than about 10 microns. This is in contradistinction to the colloidal builders used in U.S. Pat. 3,169,930, issued to Gedge, which will actually have an average particle size smaller than about 2 microns.

The liquid phase consists essentially of at least one nonionic surfactant. Nonionic surfactants typically consist of a hydrophobic long chain alkyl or alkylaryl group and hydrophilic ethoxy - and/or propoxy - groups. These types of surfactants have proven to be quite proficient at oily soil removal. As demonstrated in this application, these surfactants, however, help achieve in these detergents, surprisingly effective particulate soil removal as well and facilitate dispersion and dissolution of the mulls in cold water.

The mull achieves phase stability between its liquid and solid phases by either: (1) a weight % excess of solid phase, which is primarily builder, to liquid phase, which is primarily surfactant, and most preferably, a weight ratio thereof in excess of about 2:1 (as disclosed in the Examples of the original disclosure); (2) the presence of an amount of added water (most preferably, deionized water) from about 0.1 to 5% by weight of the mull effective to stabilize the mull; or (3) both. The inventive mulls preferred by far contain a weight % excess of said solid phase to said liquid phase. They have excellent viscosity, phase stability and handling characteristics, which is important since the inventive mulls are intended to be packaged in unit doses (i.e., washload amounts) in water-soluble delivery pouches. However, the phase stability such mulls can sometimes be further enhanced by the presence therein of about 0.1 to 5% free (added) water.

If less builder than surfactant is utilized, at least two problems will result: (1) a proportionally lowered amount of hardness control will be delivered to the wash load; and (2) reduction in phase stability. One approach towards overcoming the second problem (but not resolving the first, less hardness control), was attempted in U.S. Pat. No. 4,264,466, issued to Carleton et al. Carleton et al contend they produce mulls made of nonionic surfactants and builders, in which, however, there is always a weight excess of surfactant to builder.

To overcome the phase instability and thinness problems earlier mentioned, Carleton et al must add amounts of a chain structure clay. Chain structure clays actually can work to arrest phase instability and presumably to "thicken" a thin liquid. Unfortunately, addition of such chain structure clays can, under certain circumstances, render the mulls surprisingly less readily soluble in cold water. Therefore, such clays are not required nor are they desired in the detergent mull compositions of the invention to achieve phase stability. If any clay is present, for any other purpose, the amount thereof should be very small in order to avoid the aforesaid disadvantages. Additionally, effective dispersion of such chain structure clay requires high energy agitation, which can mean extra processing steps and costs in manufacture.

Another crucial feature of the builders which provide the solid phase of these mulls is that they have an average particle size of at least about 10 microns, and preferably range from 10 to 500 microns, more preferably 50 to 250 microns and most preferably about 50 to 175 microns.

In another attempt to solve the phase instability problem, U.S. Pat. No. 3,169,930, issued to Gedge, taught combining hydrated sodium tripolyphosphate ("STPP") with surfactant and then adding a nonaqueous solvent, such as ethylene glycol, to dehydrate the STPP (by, basically, azeotroping the water and carrying it away). This dehydration resulted in the production in situ of colloidal builder particles, which, as Gedge notes, will have a size distribution of which "about 95% is below 10 microns and about 50% is below 1.0 microns." (Column 4, lines 1–6).

Gedge taught that, unless the colloidal size particles used in his invention were used, it would not be possible to produce a phase stable composition. In fact, applicants have proven that it is possible to produce phase stable mulls by avoiding the teachings of Gedge and using particle sizes well above those used by him.

When added water is used as the phase stabilizer in the invention or as an adjunct, it is preferred to add the water to the surfactant prior to combining with the rest of the components,of the mull or to employ a surfactant already containing the requisite amount of free, i.e., chemically unbound, water. The term "added" as used herein means water in excess of the found in the commercial forms of builders and essentially non-aqueous surfactants. This appears to provide optimum rheology to the finished composition and significantly arrests phase separation of the liquid and solid phases.

Recent studies have indicated that the average wash temperature of cold water washes in the United States is approximately 65° F. but the temperature range of cold water washes is from about 90° F. to about 40° F., and a significant number of wash loads are done in water with a temperature of less than 50° F. Surprisingly, many mull detergent compositions consisting predominantly of builders and cold water soluble nonionic surfactants will not dissolve/disperse at an adequate rate in cold water washes. It has been further surprisingly discovered that if the pour point of the nonionic surfactant system in these mulls is lower than the water temperature into which the mull is placed, the mull will dissolve/disperse at a rate sufficient to be acceptable for use as a consumer product. It is desirable to formulate these mulls with surfactant systems with pour points of less than about 75° F., more preferably less than about 65° F. and most preferably less than about 40° F. to make them adequately soluble in most cold water washes.

However, generally, as the pour point of the surfactant decreases, so does its hydrophile-lipophile balance (HLB) value, and thus the pour points of the systems disclosed herein approach values much lower than is generally considered optimum for good overall detergency. As disclosed in Schick, *Nonionic Surfactants,* Vol. 2, p. 607 (1962), optimal detergency was thought present at HLB values of around 13–15. HLB values are calculated from the number of ethylene oxide or other-solubilizing groups contained in the particular nonionic surfactant. Surprisingly, the compositions disclosed in this invention nonetheless provide good detergency on both particulate and oily type soils even though the HLB values of these surfactant systems are quite low. In fact, some of the systems disclosed in this invention with the lowest HLB values provide the best overall detergency. There is no disclosure or recognition in the prior art that the dispersion/dissolution rates of these forms of detergents in cold water are highly dependent upon the pour points of the nonionic surfactant used in the formulations. Furthermore, no suggestion has been made in the prior art for conveniently delivering viscous detergent compositions containing high levels of nonionic surfactant into the washing machine.

A further potential problem with mulls containing surfactants with low pour points is that such surfactants are very fluid at room temperature, and as a result, have a greater tendency to separate from the solids in the mulls than surfactants with high pour points. This leads to phase separation upon storage of the detergent composition. It has been surprisingly found that the addition of very small amounts of water to the surfactant system will essentially eliminate phase separation in the final detergent mull composition. Water added in the range of about 0.1 to 5.0%, based on the dry (nonaqueous) weight of composition, will adequately control phase separation without significantly reducing detergent solubility or dispersibility. Although not wishing to be bound to any one particular theory, applicants believe that this effect results from flocculation of the solids in the mull which further increases their capacity to adsorb and absorb the surfactant. This is in contrast to the disclosure in U.S. Pat. No. 4,264,466, which teaches the use of chain structure clays to prevent phase separation. These clays are more expensive to use than water and the formation of the chain structure in the mull will most probably reduce the rate of dissolution/dispersion of the resultant detergent composition in cool water.

The amounts of builders and surfactants that can be included in the formulations disclosed herein can vary considerably depending on the nature of the builders, the final desired viscosity and the amount of water added to the surfactant system.

In addition, other additives commonly found in detergent compositions can also be included in the formulations described herein. These include but are not limited to further surfactants which do not render detergent dissolution/dispersion rates unacceptable, fluorescent whitening agents, bleaches, corrosion- inhibiting agents, anti-redeposition agents, enzymes, fabric softeners, perfumes, dyes and pigments.

The amount of builder in the mull can range from as low as about 30 to 50% by weight of the total composition, when free water is present therein, to as high as 90% by weight, with the surfactant system comprising about 10 to about 49% by weight of the composition to as high as 70% by weight of the composition, when free water is present, with the additional optional ingredients comprising about 0 to 60% by weight of the composition. The ratio of these ingredients should be further adjusted, along with the level of added water, which increases the viscosity when added to the formulation, to provide a mull composition with a viscosity preferably in the range of about 10,000 to 100,000 centipoise (cps) at 25° C. and 6.25 revolutions per minute as measured on a Haake Rotoviscometer with an MVII sensor, and more preferably in the range of about 20,000 to 60,000 cps and still more preferably in the range of about 30,000 to 50,000 cps.

Thus, the invention disclosed herein provides for mull detergent compositions that can be manufactured economically, will dissolve or disperse at acceptable rates in cool and cold water, have good overall cleaning performance and have controllable phase separation. The individual constituents of the novel compositions of this invention are described as follows:

NONIONIC SURFACTANT

The surfactants of choice have been selected from the nonionic surfactants including linear and branched, primary and secondary ethoxylated alcohols with an average chain length of 6 to 16 carbon atoms and averaging about 2 to 10 moles of ethylene oxide per mole of alcohol; linear and branched, primary and secondary ethoxylated, propoxylated alcohols with an average chain length of about 6 to 16 carbon atoms and averaging about 0 to 10 moles of ethylene oxide and about 1 to 10 moles of propylene oxide per mole of alcohol; linear and branched alkylphenoxy (polyethoxy) alcohols, otherwise known as ethoxylated alkylphenols, with an average chain length of 8 to 16 carbon atoms and averaging 1.5 to 30 moles of ethylene oxide per mole of alcohol; and mixtures thereof.

Particularly preferred examples of these nonionic surfactants are those containing about 6 to 10 moles of ethylene oxide per mole of alcohol. While the invention encompasses branched chain nonionic surfactants, it is well known that for commercial purposes, linear nonionics are preferred due to their better biodegradability. Exemplary of such surfactants are the Neodol (trade name of Shell Chemical Company) ethoxylate series. In particular, preferred surfactants include alcohol ethoxylates such as Neodol 91-6, which is a linear ethoxylated alcohol with a predominant chain length of about 9 to 11 carbons and averaging 6 moles of ethylene oxide per mole of alcohol, with a pour point of 45° F.; Neodol 91-8, having the same predominant carbon chain length as Neodol 91-6 averaging 8.4 moles of ethylene oxide per mole of alcohol, with a pour point of 60° F.; Neodol 23-6.5, which is a linear ethoxylated alcohol with a predominant chain length of about 12 to 13 carbons averaging 6.5 moles of ethylene oxide per mole of alcohol, with a pour point of 60° F.; Neodol 25-7, which is a linear ethoxylated alcohol with a predominant chain length of about 12 to 15 carbons averaging 7.2 moles of ethylene oxide per mole of alcohol, with a pour point of 70° F.; Neodol 25-9, having the same predominant chain length as Neodol 25-7, averaging 9 moles of ethylene oxide per mole of alcohol, with a pour point of 75° F.; and Neodol 45-7, which is a linear ethoxylated alcohol with a predominant chain length of about 14 to 15 carbons, averaging 7 moles of ethylene oxide per mole of alcohol, with a pour point of 70° F. These particular alcohol ethoxylates are characterized by having HLB values ranging from 12.0 to about 14.0 and with hydroxyl numbers (measured in milligrams of potassium hydroxide per gram) ranging from about 132-92.

Other nonionic surfactants may be selected from the Neodol ethoxylate series containing 1–5 moles of ethylene oxide per mole of alcohol. Exemplary of these particular surfactants are Neodol 91-2.5, which is a linear ethoxylated alcohol with a predominant chain length of about 9 to 11 carbons, averaging 2.5 moles of ethylene oxide per mole of alcohol, with a pour point of 5° F., and an HLB value of about 8.1; and Neodol 25-3, which is a linear ethoxylated alcohol with a predominant chain length of 12 to 15 carbons, averaging 3 moles of ethylene oxide per mole of alcohol, with a pour point of 40° F., and an HLB value of about 7.9.

Yet another particularly preferred surfactant is Surfonic JL-80X, which is an ethoxylated, propoxylated alcohol with an average chain length of 10 carbon atoms and averaging 9 moles of ethylene oxide and 1.5 moles of propylene oxide per mole of alcohol, with a pour point of 15° F., and an HLB value of about 13, available from Texaco Chemical Company.

Suitable alkylphenoxy {polyethoxy) alcohols, otherwise known as ethoxylated alkylphenols, include nonyl- and octylphenoxypoly (ethyleneoxy) alcohols, such as the Igepal series manufactured by GAF Corporation, e.g., Igepal CO-210, a nonylphenol averaging 1.5 moles of ethylene oxide per mole of alcohol, and the Triton series, manufactured by Rohm and Haas Company, e.g., Triton N-57, an ethoxylated nonylphenol averaging 5 moles of ethylene oxide per mole of alcohol.

In general, the mulls of this invention have nonionic surfactants with pour points below about 75° F., more preferably below about 65° F., and most preferably below about 40° F. Combinations of the these surfactants may be used in the detergent mulls of this invention. Preferred combinations include those which combine a surfactant with a pour point of at least about 60° F. with a surfactant with a much lower pour point such that the pour point of the combination is less than 75° F., more preferably less than 65° F., and most preferably less than 40° F. In practice, the pour point of combinations of these surfactants is usually between the pour points of each individual surfactant, but is not necessarily a weighted average of the pour points of each individual surfactant.

The predominant criterion for choosing the surfactants with particular pour points is the temperature of the cold water wash into which the mulls of this invention will be placed. Cold water wash temperatures in the United States vary greatly depending on both location and time of the year. As mentioned above, the average cold water wash has been determined to be about 65° F. However, the cold water wash temperatures can actually range from about 90° F. to about 40° F. The mulls of this invention are intended to be soluble in such wash temperatures. Therefore, the pour points of the nonionic surfactant systems within the mulls should be at least lower, more preferably about 5° F. lower, most preferably about 10° F. lower than the temperature of the wash water into which they are placed. Commercial high solids surfactants sometimes contain enough water so as to provide some or all of the added water which can be present in the novel mulls of this invention.

BUILDERS

Suitable builders can be selected in this invention from the inorganic builders such as polyphosphates, orthophosphates, metaphosphates, tetraphosphates, tripolyphosphates, phosphates, pyrophosphates, carbonates, bicarbonates, borates, metasilicates, silicates, polysilicates, aluminosilicates (zeolites) and the alkali metal and ammonium salts of any of the foregoing. Further builders can be selected from such organic builders as nitrilotriacetic acid (NTA), polycarboxylates, polyhydroxysulfonates, citrates, succinates, oxydisuccinates, polyacrylic acid, ethylenediaminetetraacetic acid (EDTA) and the alkali metal and ammonium salts of the foregoing. Mixtures of any of the builders can be used. Two particularly preferred builders are sodium carbonate and sodium tripolyphosphate. An additional preferred builder is sodium polysilicate manufactured by PQ Corporation of Valley Forge, Pa., under the trademark Britesil ®.

As previously mentioned, the combination of at least one builder and at least one low temperature pour point nonionic surfactant should be readily soluble and/or dispersible in the wash water to which it is added. For the purposes of this invention, the concept of dispersibility includes solubility. For purposes of this invention, satisfactory dispersibility is obtained when an observer is unable to visually discern any localized blue residue on fabrics washed with a mull composition containing a blue dye or pigment, or in the washing machine in which these fabrics were washed.

An additional concept which is relevant to the invention is rate of dissolution/dispersion. Over time, many solid particulates will disperse in water. However, to be acceptable for use in this invention, the mulls should dissolve/disperse in water at about 65° F. within at least about 25 minutes with gentle agitation, more preferably within about 15 minutes, and most preferably within about 10 minutes.

The particle size of the builders is not critical if the viscosity of the mull is adjusted to be in the range of about 10,000 to 100,000 centipoise. As a result, the builder used in this composition can thus be generally used as received from the supplier without an extra processing step to mill the particles to a desired size as required in U.S. Pat. No. 4,316,812.

Further, if the viscosity of the composition is maintained in the appropriate range, no dispersant is required to prevent the builders from separating from the balance of the compositions of this invention. Although U.S. Pat. No. 4,316,812 contends no dispersant is needed for its liquid detergent, in fact, all of its examples include finely divided silica ("Aerosil"), polyethylene glycol, or a combination of the two as dispersants (cf. Column 4, lines 3–7 and Example 5, column 5, line 54, showing use of polyethylene glycol).

The average particle size of the solid components of the mull compositions of this invention is preferably between 10 to 500 microns, more preferably about 50 to 250 microns, and most preferably about 50 to 175 microns. The average particle size of one of the preferred builders, sodium tripolyphosphate (STPP) - - - which, in the Examples following, constitutes a major portion of the solids in the mull compositions - - - was determined by screening and is set forth below in Table I:

TABLE I

| Average Particle Size of STPP | |
|---|---|
| Percent by weight: | Avg. Part, Size (microns) |
| 34 | <75 |
| 22 | 75–90 |
| 16 | 91–100 |
| 19 | 101–150 |
| 8 | 151–400 |
| 0.5 | >400 |

As noted above, particle size, however, is not critical, but the amounts of builder, surfactants and water must be adjusted to provide satisfactory viscosity. In the invention, the viscosity is in the range of preferably about 10,000 to 100,000 centipoise (cps) at 25° C. and at 6.25 revolutions per minute (rpm) as measured with a Haake Rotoviscometer with an MVII sensor, more preferably about 20,000 to 60,000 cps.

In order to meet the desirable criteria outlined above, the inventive mull compositions comprise preferably about 30 to 90% by weight of at least one builder, about 10 to 70% by weight at least one nonionic surfactant, and about 0 to 60% by weight adjuncts (as described below); more preferably about 40 to 80% by weight of at least one builder, about 20 to 60% by weight by at least one nonionic surfactant, and about 0 to 40% by weight adjuncts; and most preferably about 50 to 75% by weight of at least one builder, about 25 to 50% by weight of at least one nonionic surfactant, and about 0 to 25% by weight adjuncts.

PHASE STABILIZER

Added water has been used in Examples 12–14 below as a phase stabilizer and for viscosity control. In fact, in these particular uses, a clay or other thickener is not utilized. While it is not entirely understood why this added water may act as a thickener in this invention, it is believed that it may cause flocculation of the solids in the compositions of this invention which leads to further adsorption or absorption of the surfactants. The amount of water required to produce the desired viscosity and adequate phase stability appears to show a critical range. This amount ranges from about 0.1% to about 5%, more preferably 0.4% to about 2% by weight of the composition. Furthermore, deionized water is especially preferred for use, although from a commercial standpoint, tap water appears acceptable. Further, if water is present in any of the liquid components for instance, in the surfactants (e.g., some surfactants are aqueous solutions or dispersions), such water must be accounted for in the present formulations.

FLUORESCENT WHITENING AGENT

In the invention, fluorescent whitening agents, or brighteners, are preferably added to improve whitening of fabrics. Such fluorescent brighteners can be selected from stilbene brighteners, and their derivatives; styrylnaphthalene brighteners and their derivatives; and styrene brighteners and their derivatives. Exemplary of the derivatives used is the preferred brightener Tinopal ® 5BM-XC, produced by Ciba-Geigy A.G., Switzerland. Other brighteners include those disclosed in U.K. patents 1,298,577, 2,076,011, 2,026,054, 2,026,566, 1,393,042; and U.S. Pat. Nos. 3,951,960, 4,298,290, 3,993,659, 3,980,713 and 3,627,758, whose disclosures are incorporated herein by reference.

OPTIONAL SURFACTANTS

Further nonionic, anionic, cationic and amphoteric surfactants may be combined with the detergent mulls of this invention in a manner to impart greater cleaning where desired, with the proviso that such added surfactants do not render detergent solubility or dispersibility unacceptable, especially in cool or cold water (75° F.).

For example, anionic surfactants may be added to increase cleaning of particulate soils. Suitable examples of such anionic surfactants include the ammonium, substituted ammonium (e.g., mono-, di-, and triethanolammonium), alkali metal, and alkaline earth metal salts of $C_6$–$C_{20}$ fatty acids and rosin acids, linear and branched alkylbenzenesulfonates, alkyl sulfates, alkyl ether sulfates, alkanesulfonates, olefin sulfonates, hydroxyalkane-sulfonates, fatty acid monoglyceride sulfates, alkyl glyceryl ether sulfates, acyl sarcosinates, and acyl N-methyl taurides.

Further, suitable nonionic surfactants include polyoxyethylene carboxylic acid esters, fatty acid glycerol esters, fatty acid and ethoxylated fatty acid alkanolamides, certain block copolymers of propylene oxide and ethylene oxide, and block polymers of propyl-lene oxide and ethylene oxide with propoxylated ethylenediamine. Also included are such semi-polar nonionic surfactants like amine oxides, phosphine oxides, sulfoxides, and their ethoxylated derivatives.

Suitable cationic surfactants include the quaternary ammonium compounds in which typically one of the groups linked to the nitrogen atom is a $C_{12}$–$C_{18}$ alkyl group and the other three groups are short-chain alkyl groups which may bear inert substituents such as phenyl groups.

Further, suitable amphoteric and zwitterionic surfactants which contain an anionic water-solubilizing group, a cationic group, and a hydrophobic organic group include aminocarboxylic acids and their salts, iminodicarboxylic acids and their salts, alkylbetaines, alkylamidopropylbetaines, sulfobetaines, alkylimidazolinium derivatives, certain quaternary ammonium compounds, certain quaternary phosphonium compounds and certain tertiary sulfonium compounds. Other examples of suitable zwitterionic surfactants can be found described in U.S. Pat. No. 4,005,029, issued to Jones, at Columns 11–15, which are incorporated herein by reference.

Further examples of anionic, nonionic, cationic and amphoteric surfactants which may be suitable for use in this invention are depicted in Kirk-Othmer, *Encyclopedia of Chemical Technology,* Third Edition, Vol. 22, pages 347–387, and *McCutcheon's Detergents and Emulsifiers,* North American Edition, 1983, which are incorporated herein by reference.

FURTHER ADJUNCTS

Further cleaning adjuncts can include enzymes. Particularly preferred are amylases and proteases. Particularly preferred are proteases such as alkaline proteases, also denoted as subtilisins. Suitable examples include Savinase ®, Alcalase ®, and Esperase ®, all from Novo Industri A/S, Denmark and Maxacal ® and Maxatase ® from International Biosynthetics, Netherlands.

Bleaches can also be added to the compositions of this invention, preferably peroxygen bleaches such as percarbonate, perborate, and the salts thereof, e.g., sodium perborate monohydrate, and organic and inorganic peroxy compounds, such as peracids, e.g., perlauric acid, and potassium peroxymonosulfate (available from E. I. Du Pont de Nemours, Del., under the trade mark Oxone ®). Additionally, bleach activators can be incorporated, such as tetraacetylethylenediamine (TAED), ketones or aldehydes.

Yet other common detergent additives can be included in the formulas of this invention, such as dyes, pigments and colorants, exemplary of which are ultramarine blue (UMB) pigments, anthraquinone dyes, and Monastral dyes, which are manufactured by E. I. DuPont du Nemours, Del. Especially preferred is UMB to impart a pleasing color to the mull composition as well as to deliver a bluing effect on fabrics. Fabric softeners may be added to the inventive mulls. These fabric softeners are generally quaternary ammonium compounds and their salts, as disclosed in U.S. Pat. Nos. 4,250,043, issued to Jones, and 4,339,335, issued to Wixon, both of whose disclosures are incorporated herein by reference. Use of such fabric softeners is particularly favored in the mulls of this invention due to the general absence of anionic surfactants in the mulls' formulations. Further, fragrances of various sorts, most of which are ketones or aldehydes containing substituted phenyl rings, can be added to the mulls. Also, corrosion-inhibition agents and anti-redeposition agents may be included in these mulls.

DELIVERY FILMS

As noted in the foregoing, because of the physical nature of the mull detergent compositions, packaging and delivery of these compositions into the wash water cannot be implemented efficiently by most current commercial detergent packaging systems. As a result another preferred embodiment of this invention comprises a delivery system comprising (a) a water-soluble delivery pouch, which comprises a film prepared from at least one film-forming polymer and (b) an effective amount of a low temperature detergent mull which comprises at least one nonionic surfactant and a builder.

Particularly preferred films are castable, water-soluble films comprised of polyvinyl alcohols which have number average molecular weights from about 5,000–250,000. These polyvinyl alcohols generally have about 1 to 25% residual acetate groups, more preferably 5 to 20% residual acetate groups, and most preferably about 10 to 15% residual acetate groups. Additionally, such polymers as polyvinyl pyrrolidone, methyl cellulose, polyethylene oxide, gelatin and other film formers can be utilized. Plasticizers such as trimethylolpropane, glycerol, polyethylene glycol and others known to those skilled in the art can be included in the film to provide the film strength and flexibility required for producing, filling, shipping and storing the pouches prepared from these films. In addition other ingredients such as wetting agents, defoamers, and anti-blocking agents can be included in these films to aid in their manufacture and in the preparation of pouches made from these films.

The films included in this embodiment can have a thickness of from 1.0–5.0 mils, with the thickness and film material being selected to provide the optimum balance of film strength and cold water solubility. It has been found that films with a thickness of 1.5–3.5 mils produced from polyvinyl alcohol with about 12% residual acetate groups are preferred for this particular embodiment of the invention.

It has been further found that when pouches are produced from these preferred films and stored in contact with the detergent mulls of this invention, significant losses of impact strength can occur. It has been found however, that the incorporation of small amounts of known film plasticizers into the detergent mull composition itself surprisingly minimizes this loss of impact strength of the films after storage in contact with the detergent compositions. Thus, a further embodiment of this invention comprises a delivery system comprising (a) a water-soluble delivery pouch, and (b) an effective amount of a low-temperature-effective detergent mull which comprises a builder, a nonionic surfactant and 30% or less, based on the weight of the surfactant, of at least one ingredient that is suitable for use as a film plasticizer for the film used to form the water-soluble pouch.

This invention is further exemplified by the examples set forth below which are intended to illustrate but not restrict the scope of the invention. The following detergent formula was used to prepare the mull detergent compositions in Examples 1–10:

| INGREDIENT | EXAMPLES 1–10 % BY WEIGHT |
|---|---|
| Nonionic Surfactant[1] | 30.0 |
| Sodium Tripolyphosphate[2] | 55.4 |
| Sodium Carbonate[2] | 10.5 |
| Britesil ® C-24[3] | 1.5 |
| Alcalase ® 2.0T[4] | 0.7 |
| Savinase ® 8.0S[4] | 0.7 |
| Tinopal ® 5BM-XC[5] | 0.9 |
| UMB Pigment[6] | 0.1 |
| Fragrance | 0.2 |

[1]Disclosed in Table II, below.
[2]Builders.
[3]Polysilicate builder with an $SiO_2/Na_2O$ ratio of 2.4:1, manufactured by PQ Corporation of Valley Forge, Pennsylvania.
[4]Proteolytic enzymes, manufactured by Novo Industri A/S, Denmark.
[5]Fluorescent whitening agent, manufactured by Ciba Geigy A.G., Switzerland.
[6]Ultramarine Blue.

Approximately 2 kilograms of each of the 10 exemplified compositions in TABLE II were prepared by premixing the nonionic surfactants together and then mixing the surfactant system together with the remainder of the ingredients in a Hobart mixer. Relatively low shear mixing was used and a total mixing time of 15–30 minutes was sufficient to provide uniform distribution of the ingredients in the resulting mulls. The pour point of each surfactant mixture was measured using the basic procedure found in ASTM D97-66. After each composition was prepared, approximately 30 grams of each were placed in individual pouches prepared from Quiksol A film supplied by Polymer Films Inc. of Rockville, Conn. The films were 1.5 mils thick and were composed of polyvinyl alcohol with an average molecular weight of about 96,000 and approximately 12% residual acetate groups. The mulls were enclosed in the films, which were heat sealed. The resulting pouches were then placed at 40° F. for 24–48 hours (to simulate storage by the consumer, such as in a garage), removed and their solubility in 40° F. water was evaluated. This procedure involved placing the pouches in a washing machine containing 68 liters of water at 40° F., and initiating a wash cycle using the "delicate" setting to control agitation. After ten minutes, the agitation was terminated, and the machine was drained and inspected for residual detergent. Residual detergent is determined by whether any residue remains which is visually discernible in the washing machine. This is a measure of the dissolution/dispersion rates of the mull compositions. The results are shown in TABLE II, below.

TABLE II

| Example | SURFACTANT SYSTEM Neodol[1] 23-6.5 | Neodol[2] 25-9 | Neodol[3] 25-3 | Neodol[4] 91-6 | Neodol[5] 91-2.5 | Surfonic[6] JL-80X | Pour Point | Time for Detergent to Dissolve at 40° F. |
|---|---|---|---|---|---|---|---|---|
| 1. | 50% | 50% | | | | | 65° F.[7] | >10 Min. |
| 2. | | | 100% | | | | 40° F.[8] | >10 Min. |
| 3. | | | | 100% | | | 45° F.[8] | >10 Min. |
| 4. | | | | | 100% | | 5° F.[8] | <10 Min. |
| 5. | 50% | | | 50% | | | 52° F.[7] | >10 Min. |
| 6. | | | | 50% | 50% | | 36° F.[7] | <10 Min. |
| 7. | 50% | | | | 50% | | 47° F.[7] | >10 Min. |
| 8. | 50% | | 50% | | | | 51° F.[7] | >10 Min. |
| 9. | 12.5% | | | | | 87.5% | 25° F.[7] | <10 Min. |
| 10. | 12.5% | | | | 18.8% | 68.7% | 24° F.[7] | <10 Min. |

[1]Ethoxylated linear alcohols (Shell Chemical Company) with a predominant chain length of about 12–13 carbons and averaging about 6.5 moles of ethylene oxide per mole of alcohol.
[2]Ethoxylated linear alcohols (Shell Chemical Company) with a predominant chain length to about 12–15 carbons and averaging about 9 moles of ethylene oxide per mole of alcohol.
[3]Ethoxylated linear alcohols (Shell Chemical Company) with a predominant chain length of about 12–15 carbons and averaging about 3 moles of ethylene oxide per mole of alcohol.
[4]Ethoxylated linear alcohols (Shell Chemical Company) with a predominant chain length of about 9–11 carbons and averaging about 6 moles of ethylene oxide per mole of alcohol.
[5]Ethoxylated linear alcohols (Shell Chemical Company) with a predominant chain length of about 9–11 carbons and averaging about 2.5 moles of ethylene oxide per mole of alcohol.
[6]Ethoxylated, propoxylated linear alcohols (Texaco Chemical Company) with a predominant chain length of about 10 carbons, and averaging about 9 moles of ethylene oxide and 1.5 moles of propylene oxide per mole of alcohol.
[7]Pour point value determined by procedure adopted from ASTM D97-66.
[8]Pour point value shown in manufacturer's literature.

Reviewing TABLE II, one can see that the composition of Example 1, which contains two surfactants, Neodol 23-6.5 and Neodol 25-9, which are considered to be water soluble by their manufacturer, failed to completely dissolve at 40° F. under the test conditions. In addition when this composition was stored at 70° F. and added to wash water at 63° F., it again failed to completely dissolve under the test conditions described previously. Example 4, by comparison, which contains Neodol 91-2.5, dissolved/dispersed completely in the cold (40° F.) water even after storage at 40° F. This was particularly surprising since this particular surfactant is considered by its manufacturer to be less soluble in water than both of the surfactants used in Example 1. Thus, surprisingly, adding a surfactant that is apparently less soluble in water to the remaining components of Examples 1–10 improved the dissolution/dispersion rates of the mull compositions in cold water.

Further examination of Table II shows that Examples 4, 6, 9 and 10, with a surfactant or a mixture of surfactants with pour points less than or equal to about 36° F. completely dissolved/dispersed in 40° F. water under the test conditions described above. Thus, the applicants have concluded that the dissolution/dispersion rates of the mulls of this invention are related to the pour points of the surfactants in these mulls and that the pour points should be at least lower than the temperature of the water in which the mulls are to be placed to provide acceptable dissolution/dispersion rates in the water. Apparently, the examples which employ the lower pour point surfactant maintain more fluidity in cold water, which facilitates their dispersion. It is surprising that these differences in fluidity of already viscous samples are more important than overall water solubility in controlling the rates of dissolution/dispersion of these compositions in cold water.

Performance studies on cotton, cotton/polyester blends, and polyester fabrics soiled with a synthetic sebum or a synthetic clay soil (Performance Test I) show that reducing the pour point of the surfactant does not reduce the cleaning efficacy of these compositions even if the HLB value is reduced to a level much lower than that normally prescribed for good detergency. Thus, the compositions of this invention provide good cleaning as well as good solubility/dispersibility characteristics. The cleaning performance was evaluated by washing swatches treated with these soils in water at 100° F. containing 100 ppm water hardness (as $CaCO_3$) with a molar ratio of $Ca^{2+}:M^{2+}$ of 3:1 and a concentration of 0.08% of the appropriate detergent mull composition in a commercial washing machine. The reflectance values of the swatches were measured before and after washing, and the Kubelka-Munk equation was used to calculate % soil removal.

| | | PERFORMANCE TEST I % SOIL REMOVAL | | | | | |
|---|---|---|---|---|---|---|---|
| | | COTTON | | POLYCOTTON | | POLYESTER | |
| EXAMPLE | HLB | SEBUM | CLAY | SEBUM | CLAY | SEBUM | CLAY |
| 1 | 12.6 | 87.4 | 86.7 | 79.9 | 99.5 | 82.1 | 99.2 |
| 6 | 10.3 | 89.1 | 89.5 | 80.6 | 99.6 | 85.6 | 99.5 |
| 9 | 12.9 | 88.6 | 89.1 | 73.1 | 99.0 | 81.5 | 99.4 |
| 10 | 11.9 | 89.6 | 90.2 | 78.2 | 100 | 86.7 | 100 |
| LSD[1] | | 2.6 | 3.1 | 4.1 | 1.5 | 2.9 | 0.5 |

[1]LSD is at 90% confidence level.

It was particularly surprising that Examples 6 and 10 performed so well, since they each contain a significant amount of Neodol 91-2.5, which is not merely considered insoluble by its manufacturer, but unsuited for good detergency as well. Further surprising results were obtained with Example 10. Example 10 is a ternary system containing mixtures of three nonionic surfactants, two of which have very low pour points (Neodol 91-2.5 and Surfonic JL-80X). On two fabrics, cotton and polyester, this ternary system had significantly better detergency than the composition of Example 1, which was unexpected based on the HLB's of the surfactant systems.

PERFORMANCE TEST II

Selected examples based on the compositions of TABLE II were tested for performance at 40° F., under the same conditions as the foregoing, except for temperature and the use of only cotton and polyester fabrics. The results for % soil removal of both sebum (oily) and clay (particulate) soils are shown below:

| | | | % SOIL REMOVAL[4] | |
|---|---|---|---|---|
| SURFACTANT | HLB | FABRIC | SEBUM | CLAY |
| Neodol 23-6.5[1] | 12.0 | Cotton | 75.2 | 83.9 |
| Neodol 91-2.5/[2] 91-6 | 10.3 | " | 82.1 | 83.2 |
| Neodol 23-6.5[1] | 12.0 | Polyester | 84.1 | 96.8 |
| Neodol 91-2.5/[2] 91-6 | 10.3 | " | 90.7 | 96.4 |
| LSD[3] | | | 3.9 | 2.3 |

[1]100% of this surfactant was used.
[2]50%/50% mixture of these surfactants was used.
[3]LSD is at 90% confidence level.
[4]Mulls were predissolved in the water before tests were initiated.

The above results show that a combination of nonionic surfactants having a reduced pour point and reduced HLB values surprisingly demonstrated soil removal properties in a low temperature wash as good as or better than a single nonionic surfactant which one would expect to have better solubility and detergency than the combination.

EXAMPLES 11–12

50 kilogram quantities of mull detergent compositions were prepared using a ribbon blender and the formulas are summarized below. In Example 12, the water was added to the surfactant system before this system was mixed with the rest of the composition.

| | EXAMPLE 11 % | EXAMPLE 12 % |
|---|---|---|
| Neodol 23-6.5 | 3.7 | 3.7 |
| Surfonic JL-80X | 26.3 | 26.1 |
| Deionized Water | — | 0.6 |
| Sodium Tripolyphosphate | 55.4 | 55.0 |
| Sodium Carbonate | 10.5 | 10.5 |
| Britesil ® C-24 | 1.5 | 1.5 |
| Alcalase ® 2.0T | 0.8 | 0.8 |
| Savinase ® 8.0S | 0.6 | 0.6 |
| Tinopal ® 5BM-XC | 0.9 | 0.9 |
| Pigment | 0.1 | 0.1 |
| Fragrance | 0.2 | 0.2 |

The composition of Example 11 was observed to have phase separation after storage at room temperature. The separation was quantified by placing 1000 grams of the composition in a one-liter graduated cylinder for one week at room temperature and then removing and weighing the separated liquid phase that appeared on top of the remainder of the composition. It was found that the weight of the liquid totaled 4.8% of the total composition. When the detergent of composition 12 was evaluated under the same conditions, 0.1% or less liquid phase separation was observed.

Furthermore, 2 kilogram quantities of the detergent composition in Example 12 were prepared and tested for solubility as were Examples 1–10. The composition of Example 12 dissolved/dispersed completely in less than ten minutes in 40° F. water.

EXAMPLES 13–14

2 kilogram quantities of mull detergent compositions were prepared using a Hobart mixer and their formulas are summarized below. Approximately 25 grams of each composition were placed in a 2×3 inch water-soluble pouch constructed from a 2.5 mil thick film comprised predominately of polyvinyl alcohol (number average molecular weight of about 10,000 and about 12% residual acetate groups) with 5% glycerol and 4% trimethylolpropane as plasticizers. The pouches were stored for nine weeks at 70° F./50% relative humidity.

| | EXAMPLE 13 % | EXAMPLE 14 % |
|---|---|---|
| Neodol 23-6.5 | 3.7 | 3.6 |
| Surfonic JL-80X | 26.1 | 25.6 |
| Deionized Water | 0.6 | 0.6 |
| Sodium Tripolyphosphate | 55.0 | 54.0 |
| Sodium Carbonate | 10.5 | 10.3 |
| Britesil ® C-24 | 1.5 | 1.5 |
| Alcalase ® 2.0T | 0.8 | 0.8 |
| Savinase ® 8.0S | 0.6 | 0.6 |
| Tinopal ® 5BM-XC | 0.9 | 0.9 |
| Pigment | 0.1 | 0.1 |
| Fragrance | 0.2 | 0.2 |
| Glycerol | — | 0.9 |
| Trimethylolpropane | — | 0.9 |

After nine weeks of storage, the film from the pouches containing the composition of Example 13 was obviously brittle while the film from the pouches containing the composition of Example 14 was much more flexible. Impact strength measurements made on these films using a Rheos Total Energy Impact Strength Tester and testing conditions of 35° F./42% relative humidity indicate that the films used with the composition in Example 14 had about five times more impact strength than the films used with the composition in Example 13. As previously discussed, this shows that the addition of plasticizer directly to the mull minimizes the loss of film impact strength when the film is exposed to the mull. This was unexpected and further shows the unobvious characteristics of the delivery system of this invention.

In further examples below, applicants tested the inventive mull compositions against those to which chain structure clays were added, in the manner of U.S. Pat. No. 4,264,466 (Carleton et al). The comparison was performed to see whether chain structure clays, which Carleton et al require for phase stability, were suitable for use in the invention.

The following base formulation was used for Examples 15–17;

| Ingredient | Wt. (gms) | Wt. % |
|---|---|---|
| Alcalase 2.0T[1] | 8.2 | 0.82 |
| Sodium Tripolyphosphate[2] | 549.3 | 54.93 |
| Sodium Carbonate[2] | 104.6 | 10.46 |
| Britesil C-24[3] | 15.1 | 1.51 |
| Tinopal 5BM-XC[4] | 8.9 | 0.89 |
| Ultramarine Blue[5] | 1.2 | 0.12 |
| Neodol 23-6.5[6] | 37.2 | 3.72 |
| Surfonic JL-80X[7] | 260.7 | 26.07 |
| Savinase 8.0S[1] | 5.8 | 0.58 |

-continued

| Ingredient | Wt. (gms) | Wt. % |
|---|---|---|
| Fragrance | 4.5 | 0.45 |
| Deionized Water | 5.5 | 0.55 |
| | 1,000.0 | 100.00 |

[1]Alkaline protease from Novo Industri A/S, Bagsvaerd, Denmark.
[2]Builder
[3]Sodium Polysilicate Builder from PQ Corp. of Valley Forge, PA.
[4]Fluorescent Whitening Agent from Ciba-Geigy A.G., Basel, Switzerland.
[5]Pigment
[6]Linear ethoxylated alcohol nonionic surfactant averaging 12–13 carbon atoms and containing about 6.5 moles of ethylene oxide per mole of alcohol.
[7]Propoxylated, ethoxylated alcohol nonionic surfactant averaging 10 carbon atoms, and containing an average of 9 moles of ethylene oxide and 1.5 moles of propylene oxide per mole of alcohol.

Example 15

The first six ingredients of the base mixture were dry blended. The last five items were then slowly added. The resultant base mixture was mixed with moderate stirring in a Hobart mixer to produce a mull of this invention.

Example 16

470 grams of the base mixture were retained in the mixer. To this were slowly added, with good mixing, 30 grams of Attagel 50 (chain structure clay, from Engelhard Minerals and Chemicals Co.). The previously grainy texture was observed to become smoother, attaining an appearance similar to modelling clay. A mixture with 6% clay resulted.

Example 17

In another sample, 282 grams of the base mixture were added to 12 grams of Attagel 50 by placing the mixture in a stainless steel mixing bowl and shearing at a high rate while gradually adding the clay. A mixture with 4% clay resulted. The two clay - including formulations and the base mixture (control) were then tested for solubility in cool water (75°–78° F., 23.9°–25.5° C.) in a standard washing machine. The samples were shaped into spheroids in order to avoid variations in shape which could affect dispersion in water. Dispersion/dissolution was monitored by fluorometric assay of how much fluorescent whitening agent was released into the water. The test was carried out in a standard 12 minute wash cycle with gentle agitation. The results were as follows:

TEST III

| Example | Formulation | FWA Release in 12 Minutes |
|---|---|---|
| 15 | (Control; no Clay) | Complete |
| 16 | (Base Mixture with 6% Clay) | 20% |
| 17 | (Base Mixture with 4% Clay) | 20% |

The above results demonstrate that after 12 minutes in cool water under gentle agitation, the inventive formulation of Example 15 virtually completely dissolved. On the other hand, the chain structure clay - containing mixtures of Examples 16 and 7 were 80% undissolved. This shows the surprising results obtained with the inventive detergent mull compositions and proves the superiority of the invention over the teachings of Carleton et al.

Test IV

Stability of Inventive Mulls vs. U.S. Pat. No. 4,264,466

In Examples 11–12 above, it is demonstrated that the amount of separation into liquid and solid phases was very low for both water and non-water containing formulations. The weight of the separated liquid (after one week at room temperature) in Example 11, the non-water containing formulation, was only 4.87% of the entire composition. Using a specific gravity of 1.0 for the liquid phase and 1.5 for the total composition, this converts to 7.2% separation by volume:

$$\text{volume of liquid} = \frac{4.87\text{ g}}{1\text{ g/ml}} = 4.87\text{ ml}$$

$$\text{volume of composition} = \frac{100\text{ g}}{1.5\text{ g/ml}} = 66.7\text{ ml}$$

$$\%\text{ separation} = \frac{4.87}{66.7} \times 100 = 7.3\%$$

This compares favorably with the separation exhibited by Example A of TABLE VI in the Carleton et al reference. In this example, a formulation containing only a chain structure forming clay as a suspension aid developed 0.6 cm of liquid after one week at 70° F.

$$\text{This represents } \frac{0.6}{6.0} \times 100 = 10\%\text{ separation.}$$

Thus, the applicants' mull with 7.3% phase separation, exhibited phase stability which was at least as good as the Carleton et al clay - thickened formulations. In TEST V, below, the importance of the weight excess builder:surfactant ratio previously disclosed in Examples 1–14 of the original disclosure was demonstrated. The control (Example 20) was at 1:1 builder:surfactant.

| INGREDIENT WT. (gms.) | 18 | 19 | 20 | 21 |
|---|---|---|---|---|
| Sodium Tripolyphosphate[1] | 180 | 167 | 150 | 200 |
| Nonionic Surfactant[2] | 120 | 133 | 150 | 100 |
| Ultramarine Blue[3] | 0.36 | 0.36 | 0.36 | 0.36 |
| Builder to Surfactant Ratio | 1.5 | 1.25 | 1.0 | 2.0 |

[1]Builder
[2]Surfonic JL-80X
[3]Pigment, to color the detergent mull

The formulations were placed in 4 oz. bottles to an initial height of 6 cm. The samples were stored for four weeks at 70° F. or 120° F., during which period the volume of liquid on top of the formulations was measured. The results are as follows:

STABILITY TEST V
(Syneresis values in cm)

| | 18 | | 19 | | 20 | | 21 | |
|---|---|---|---|---|---|---|---|---|
| WEEKS | 70° F. | 120° F. | 70° F. | 120° F. | 70° F. | 120° F. | 70° F. | 120° F. |
| 1 | 0.1 | 0.1 | 0.2 | 0.4 | 0.7 | 0.7 | 0.0 | 0.1 |
| 2 | 0.1 | 0.1 | 0.3 | 0.3 | 0.8 | 0.8 | 0.0 | 0.0 |
| 3 | 0.1 | 0.1 | 0.3 | 0.3 | 0.8 | 0.8 | 0.0 | 0.0 |
| 4 | 0.1 | 0.1 | 0.3 | 0.3 | 0.8 | 0.8 | 0.0 | 0.0 |

Review of the above stability tests demonstrate that when an excess of builder to surfactant is present, dramatically improved stability results. The 1.25 ratio of Example 19 showed around 50% better syneresis values than those of Example 20. Those of Example 18, with a 1.5 ratio, were even better. The most preferred formula, as shown in 21, had virtually no syneresis.

Additional experiments were undertaken in TEST VI, below, to demonstrate the use of defined amounts of water as a phase stabilizer. In these Examples, the base formulations used in Examples 18–20 were used, in which the major actives were surfactant and builder, with ultramarine blue as a colorant. Testing methodology was the same as described previously. The stabilities of these formulations Which are now denoted Examples 22, 23 and 24 (corresponding to 18, 19, and 20, respectively) were tested:

STABILITY TEST VI
(Syneresis Values in cm)

EXAMPLE 22

| % water | 1% | | 3% | | 5% | |
|---|---|---|---|---|---|---|
| WEEKS | 70° F. | 120° F. | 70° F. | 120° F. | 70° F. | 120° F. |
| 1 | 0.1 | 0.1 | 0.0 | 0.1 | 0.0 | 0.1 |
| 2 | 0.1 | 0.1 | 0.0 | 0.0 | 0.0 | 0.0 |
| 3 | 0.1 | 0.1 | 0.0 | 0.0 | 0.0 | 0.0 |
| 4 | 0.1 | 0.1 | 0.0 | 0.0 | 0.0 | 0.0 |

EXAMPLE 23

| % water | 1% | | 3% | | 5% | |
|---|---|---|---|---|---|---|
| WEEKS | 70° F. | 120° F. | 70° F. | 120° F. | 70° F. | 120° F. |
| 1 | 0.2 | 0.3 | 0.1 | 0.1 | 0.0 | 0.1 |
| 2 | 0.2 | 0.2 | 0.1 | 0.1 | 0.0 | 0.0 |
| 3 | 0.2 | 0.2 | 0.1 | 0.1 | 0.0 | 0.0 |
| 4 | 0.2 | 0.2 | 0.1 | 0.1 | 0.0 | 0.0 |

EXAMPLE 24

| | 1% | | 3% | | 5% | | 10% | |
|---|---|---|---|---|---|---|---|---|
| % water WEEKS | 70° F. | 120° F. | 70° F. | 120° F. | 70° F. | 120° F. | 70° F. | 120° F. |
| 1 | 0.6 | 0.7 | 0.4 | 0.5 | 0.1 | 0.2 | 0.1 | 0.1 |
| 2 | 0.7 | 0.7 | 0.4 | 0.4 | 0.2 | 0.1 | 0.0 | 0.0 |
| 3 | 0.7 | 0.7 | 0.4 | 0.4 | 0.2 | 0.1 | 0.0 | 0.0 |
| 4 | 0.7 | 0.7 | 0.4 | 0.4 | 0.2 | 0.1 | 0.0 | 0.0 |

Review of the above experimental results demonstrates the surprising physical stability of the invention. This stability is achieved by using an excess of builder to surfactant and water levels from 0.1 to about 5%. It appears from the data that phase stability problems with formulations that do not contain an excess of builder can be overcome if more that 5% water is added (Example 24). However, it is undesirable to add more than 5% water because 1) some materials such as enzymes may be denatured; 2) the rheology of the mulls may be adversely affected; and 3) the dispersibility with the mulls may be affected.

The invention is further illustrated by reference to the claims which follow below.

What is claimed is:

1. A detergent composition in the form of a low-temperature wash water dispersible mull consisting essentially of (a) 30–90% of particulate solid builder having an average particle size of greater than about 10 microns and selected from the group consisting of polyphosphates, orthophosphates, metaphosphates, tetraphosphates, tripolyphosphates, phosphates, pyrophosphates, carbonates, bicarbonates, borates, silicates, polysilicates, aluminosilicates, metasilicates, nitrilotriacetic acid (NTA), polycarboxylates, polyhydroxysulfonates, citrates, succinates, oxydisuccinates, polyacrylic acid, ethylenediaminetetraacetic acid (EDTA) and the alkali metal and ammonium salts of the foregoing, (b) 10–70% of at least one nonionic surfactant having a pour point of less than 75° F., thereby rendering said mull readily dispersible in cold wash water, and optionally (c) 0–60% of one or more adjuncts selected from the group consisting of anionic, cationic and amphoteric surfactants and mixtures thereof; fluorescent whitening agents; anti-redeposition agents; anti-corrosion agents; bleaches; dyes; pigments; fabric softeners; enzymes; and fragrances, and wherein said mull is rendered phase stable by the presence therein of (i) a weight percent of said particulate builder which exceeds the weight percent of said liquid nonionic surfactant and (ii) 0.1 to 5% by weight of the mull of added water.

2. The composition of claim 1 wherein the builder is sodium carbonate or sodium tripolyphosphate.

3. The composition of claim 1 wherein the nonionic surfactant is selected from the group consisting of:

linear and branched, primary and secondary ethoxylated alcohols with an average chain length of 6 to 16 carbon atoms and averaging about 2 to 10 moles of ethylene oxide per mole of alcohol; linear and branched, primary and secondary ethoxylated, propoxylated alcohols with an average chain length of about 6 to 16 carbon atoms and averaging about 0 to 10 moles of ethylene oxide and about 1 to 10 moles of propylene oxide per mole of alcohol; linear and branched alkylphenoxy (polyethoxy) alcohols with an average chain length of 8 to 16 carbon atoms and averaging 1.5 to 30 moles of ethylene oxide per mole of alcohol; and mixtures thereof.

4. The composition of claim 1 wherein the fluorescent whitening agents include stilbene, styrylnaphthalene and styrene brighteners and their derivatives.

5. The composition of claim 1 wherein the pigment is ultramarine blue.

6. The composition of claim 1 wherein the enzymes include amylases and proteases.

7. The composition of claim 1 wherein the pour point of said liquid nonionic surfactant is less than about 65° F.

8. The composition of claim 1 wherein the pour point of the said liquid nonionic surfactant is less than about 40° F.

9. The composition of claim 1 comprising a mixture of at least two nonionic surfactants, having a combined pour point of less than about 40° F.

10. The composition of claim 1 comprising a mixture of three or more nonionic surfactants, having a combined pour point of less than about 40° F.

11. The composition of claim 1 wherein the liquid phase has a pour point of at least about 5° F. less than the water in which the mull is expected to be used.

12. A premeasured, low-temperature-effective delivery system comprising a cold water soluble delivery pouch enclosing a mull according to claim 1.

13. The delivery system of claim 12 wherein the delivery pouch comprises a film which is prepared from at least one film-forming polymer selected from the group consisting of:

polyvinyl alcohol, polyvinyl pyrrolidone, methyl cellulose, polyethylene oxide, gelatin and mixtures thereof.

14. The delivery system of claim 13 wherein the polymer is a polyvinyl alcohol with a number average molecular weight of about 5,000 to 250,000 and about 1–25% residual acetate groups.

15. The delivery system of claim 14 wherein the film contains at least one plasticizer.

16. The delivery system of claim 15, wherein the mull further contains (d) at least one film plasticizer in an amount of no more than about 30% by weight of the surfactant of (a).

17. A method for laundering fabrics comprising contacting the fabrics with wash water containing dispersed therein the detergent mull of claim 1.

18. A method for laundering fabrics, comprising dispersing the delivery system of claim 12 into the wash water in which the fabrics are laundered.

* * * * *